United States Patent [19]

Shames et al.

[11] 4,313,564

[45] Feb. 2, 1982

[54] SELF-CLEANING AERATOR WITH NOISE REDUCTION

[76] Inventors: Sidney J. Shames, 57 Holly Pl., Briarcliff Manor, N.Y. 10510; Harold Shames, 5 Agnes Cir., Ardsley, N.Y. 10502

[21] Appl. No.: 166,341

[22] Filed: Jul. 7, 1980

Related U.S. Application Data

[63] Continuation-in-part of Ser. No. 4,061, Jan. 17, 1979, Pat. No. 4,214,702, which is a continuation-in-part of Ser. No. 938,901, Sep. 1, 1978, Pat. No. 4,221,335.

[51] Int. Cl.[3] ..... E03C 1/08

[52] U.S. Cl. ..... 239/110; 239/428.5

[58] Field of Search ..... 239/106–113, 239/428.5, 562, 570, DIG. 18; 261/DIG. 22; 181/264, 265

[56] References Cited

U.S. PATENT DOCUMENTS

| | | | |
|---|---|---|---|
| 2,896,863 | 7/1959 | Shames et al. | 239/428.5 |
| 3,014,665 | 12/1961 | Shames et al. | 239/428.5 X |
| 3,684,191 | 8/1972 | Shames et al. | 239/428.5 |

*Primary Examiner*—Andres Kashnikow
*Attorney, Agent, or Firm*—Norman Lettvin

[57] ABSTRACT

An aerator, that includes jet-defining slots and jet-fragmenting surface therein, formed in molded plastic parts, is provided with both self-cleaning character by using a movable valve member and a flow-directing washer of shape-retaining character upstream thereof, and with a noise reduction feature obtained by providing on the movable valve member a centrally located conical projection that, in the non-flow condition, extends through and upstream of the flow directing washer.

4 Claims, 6 Drawing Figures

SELF-CLEANING AERATOR WITH NOISE REDUCTION

This application is a continuation-in-part of our copending application, Ser. No. 4061, filed Jan. 17, 1979, now issued as U.S. Pat. No. 4,214,702 and is also a continuation-in-part of our copending application, Ser. No. 938,901 filed Sept. 1, 1978, now issued as U.S. Pat. No. 4,221,335.

FIELD OF THE INVENTION

This invention relates to a self-cleaning aerator, for use on faucets and the like, and more particularly relates to a self-cleaning aerator that employs a movable valve member that is also constructed and arranged to provide a noise reduction feature in the self-cleaning aerator.

BACKGROUND OF THE INVENTION

An essential element of all aerators is a jet-forming means provided within a casing from which a plurality of relatively fine jets of liquid, such as water, are discharged into a mixing chamber to be fragmented and mixed intimately with air, after which straightening means operate to cause a coherent stream of aerated liquid to be discharged from the aerator. The jet-forming means have typically been in the form of a perforated disc or the equivalent.

When usage of aerators disclosed the fact that the disc perforations tended to clog with water-borne debris, a self-cleaning aerator was developed in which the jet-defining flow apertures of a metal disc, or equivalent, were provided by two mating metal parts that were resiliently separable, during the non-flow condition, to permit debris to be flushed between the separated edges of the two parts before water pressure of the steady flow condition operated to restore the two parts to their mating condition. Such prior art constructions are disclosed in U.S. Pat. Nos. 2,707,624; 2,896,863; 2,928,607; and 3,014,665.

The use of plastic apertured discs in aerators has operated to reduce the cost of the aerator. But the use of plastic parts to define jet-forming flow apertures did not permit effective use of the same self-cleaning feature as first disclosed in U.S. Pat. No. 2,707,624. It has been the experience that jet-defining flow apertures preferably be provided in their entirety in a single part, and should not be defined between edges of two mating parts.

One of the most effective designs of an aerator using plastic internal parts is disclosed in U.S. Pat. No. 3,684,191 wherein one internal part is in the form of an annular guide ring, and a second internal part, made wholly of plastic, is in the form of a flanged, cup-shaped, plug member with a series of fine vertical jet-forming slots defined therethrough. The fine vertical slots in the plug member are susceptible of being clogged by water-borne debris.

It is, therefore, one object of this invention to provide self-cleaning character for an aerator whose jet-forming apertures are defined in a molded plastic part, whereby water-borne debris may be automatically flushed from the aerator without disassembly of the aerator, or removal of the aerator from its operative environs.

It is another object of this invention to provide a self-cleaning aerator wherein the liquid flow therethrough is automatically controlled to effect, upon initial liquid flow, an increased and directed liquid velocity therethrough to effect a directed scrubbing, and debris dislodging, flow action over the jet-forming apertures, after which a steady state condition, for which the aerator is designed, will be established.

A further object of this invention is to provide a self-cleaning aerator that is characterized by economy of construction and effectiveness of operation.

Still a further object of this invention is to provide a self-cleaning aerator that achieves the foregoing objects and that additionally includes a noise reduction feature for reducing production of sound that accompanies the flow of water through an aerator.

Further objects and advantages will become apparent to one skilled in the art from the following description of preferred embodiments of the invention.

BRIEF SUMMARY OF THE INVENTION

An aerator with internal plastic parts of the type generally disclosed in U.S. Pat. No. 3,684,191 is provided with self-cleaning character by modifying the jet-forming, cup-shaped, plug member to provide a central flow opening therein through which debris may be discharged after being flushed and scrubbed, by liquid flow, from the jet-forming slots or apertures in the plug member.

To effect flushing and scrubbing of the jet-forming slots, an upstream apertured washer is provided with concentric flow aperture means therein. The inner flow aperture means is normally closed by a resiliently-biased, flow-blocking, valve member when there is no flow through the aerator, and so that initial flow of water through the aerator is directed through the outer flow aperture means which are positioned to direct a sheet of liquid, at increased velocity, over and across the jet-forming slots downstream of the washer, to effect a scrubbing of debris from said slots and to effect discharge of the debris and initial flow of liquid downstream through the central flow opening of the plug member.

The application of liquid force against the flow-blocking valve member does cause same to move downstream against the resilient bias force transmitted from a helical spring. The downstream shape of the valve member is selected and arranged to complement and close the central flow opening in the plug member. A resilient flange provided on the valve member is shaped and arranged to form a seal with a shaped seat surrounding the central flow opening in the plug member, so that during steady state operation the aerator operates as disclosed in U.S. Pat. No. 3,684,191.

The slight time delay, between the two extremes when there is initial liquid flow and when the valve has seated to close the central flow opening in the plug member, provides a time period when there is provided desirable fluctuating pressure drops and surges in the region adjacent the jet-forming slots that aids in dislodging and flushing debris that has been temporarily lodged in the jet-forming slots of the plug member.

The flow-directing washer is of shape-retaining character to insure obtaining the desired flow therethrough and downstream thereof. While it may be possible to effect a liquid-tight seal thereagainst, a distortable, resilient washer is included upstream of the shape-retaining washer to insure the required liquid-tight seal between the aerator and the discharge spout of a faucet.

The valve of the aerator is so shaped in coordination with the flow-directing washer as to obtain a noise reduction during the functioning of the aerator.

The aerator itself may be provided with any means for attachment, including a male threaded or female threaded casing as seen in FIGS. 1 and 5 of U.S. Pat. No. 3,684,191, and the casing itself may be enclosed within an outer imperforate casing, or sleeve, that provides surrounding vertical air passageways, that provide the known effect of a slotless aerator, the latter also being disclosed in said U.S. patent.

The invention herein will be better understood by reference to the following detailed description when considered in connection with the accompanying drawings.

BRIEF DESCRIPTION OF THE DRAWINGS

FIG. 5 is a top plan view of the aerator shown in FIG. 4 and further shows a section line 4—4 illustrating the plane in which FIG. 4 is located.

Figure 1:
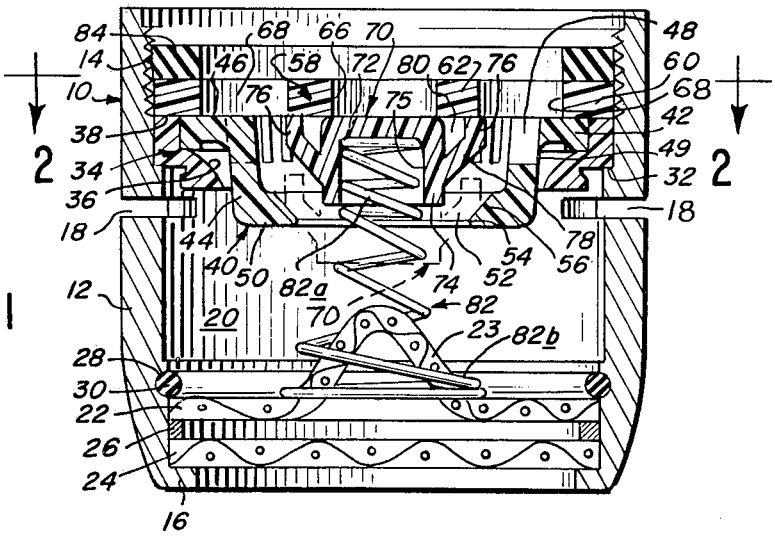
FIG. 1 is a vertical axially cross-sectional view through one form of aerator constructed in accord with the features and principles of this invention.
Figure 2:
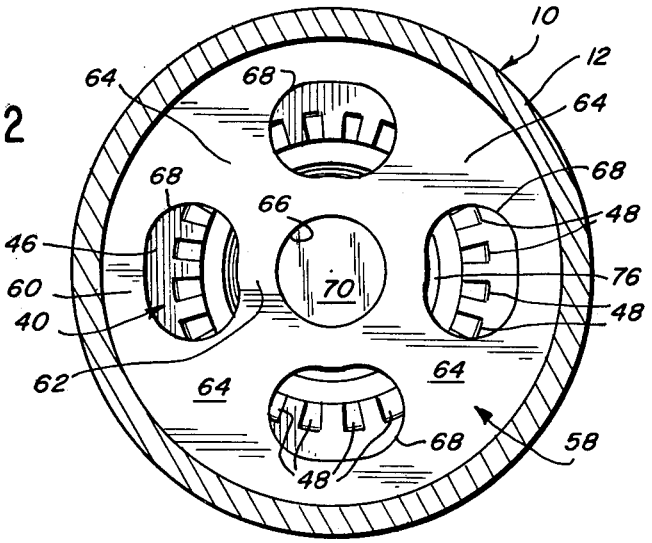
FIG. 2 is a cross-sectional view taken substantially on line 2—2 of FIG. 1, showing the flow passageways through the washer and the relationship of those passageways with the jet-forming slots in the plug member that is downstream of the washer.
Figure 3:
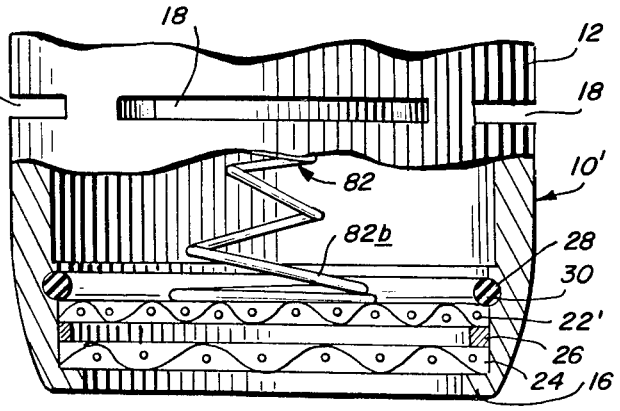
FIG. 3 is a fragmentary view, partly in elevation and partly in cross-section, showing the lower portion of the casing and interior construction of a modified form of aerator construction.

Like parts in FIGS. 1 and 3 are identified by the same numeral, and where a modification is made, similar parts carry the same numeral primed. Parts shown in FIGS. 4–6 which correspond with parts in FIGS. 1–3 are identified with the same numeral, but where a modification is made, similar parts carry the same numeral primed.

DETAILED DESCRIPTION OF THE INVENTION

Referring now to the drawings, there is shown in FIG. 1 an aerator generally indicated at 10 that includes an axially elongated casing 12 having upstream and downstream ends respectively at upper and lower ends of the Figure. The specific casing shown is female threaded at 14 at the upstream end, and the casing provides an inturned flange 16 at the downstream end to support the lowermost screen that is hereinafter referred to.

The side wall of casing 12 is provided with three slots 18 through which air is ingested into a mixing chamber 20 that is located generally centrally of the ends of the casing. The downstream end of mixing chamber 20 is bounded by upper and lower disc-like screens 22 and 24 of very coarse mesh, contrasted with fine mesh screens normally used in aerators, separated by a ring-like spacer 26 that is press fit into position within casing 12. While two screens are shown, the use of more screens or only one screen is also contemplated. The casing 12 is provided with an internal groove 28 that receives a split ring screen retainer 30 that extends inwardly to overlie the peripheral edge of the upper screen 22. The lower screen 24 abuts inturned flange 16.

The casing 12 is provided with an annular support shoulder 32, upstream of the air intake slots 18, which serves as a support for aerating parts positioned upstream of mixing chamber 20. The aerating parts include an annular guide ring 34 that is a unitary part molded of a plastic, preferably Delrin. Guide ring 34 is shaped to provide thereon an annular convex impingement surface 36 which extends radially inwardly and curves in a downstream direction. The portion of surface 36 against which the liquid jets impinge is located outwardly and downwardly of the apertures through which the liquid jets issue. Guide ring 34 has an upstream, annular, support edge surface 38 located in a plane that is perpendicular to the longitudinal axis of casing 12.

The aerating parts also include a cup-shaped plug member, generally 40, that is also molded of a plastic, preferably Delrin. Plug member 40 has a generally shallow cup shape, and has an annular support flange 42 extending radially outwardly. The support flange 42 is slidingly telescoped into and supported on guide ring 34, with the lower edge of flange 42 engaging the uppermost part of convex surface 36. The plug member 40 provides an upright, generally cylindrical, side wall 44 that projects downstream from the radial inner edge of the annular peripheral flange 42. The upstream surface 46 of the support flange 42, and upstream edge of wall 44, lie in the same plane as the annular support edge 38 of the guide ring.

The upright side wall 44 is provided therein with a series of circumferentially spaced, axially elongated, radial slots 48 that extend downstream from the upstream side 46 of the support flange 42. The slots 48 operate to form and provide the liquid jets required to be fragmented to effect aeration of liquid passing through the aerator. The slots 48 extend part way down the axial length of side wall 44 and provide radially outwardly disposed discharge ports 49 that are seen below flange 42, and which are constructed to direct liquid jets issuing therefrom against the surface 36 on the guide ring 34. The lower end of wall 44 turns inwardly to provide a transverse wall 50 on the cup-shaped plug member 40.

What has thus far been described are construction features for aerators that are disclosed in U.S. Pat. No. 3,684,191. The improvement features of the instant invention will now be described.

In the form of invention shown in FIGS. 1 and 2, the plug member 40 is formed as an annulus having a relatively large central flow opening 52 through its downstream transverse wall 50. The opening 52 is bounded by a downstream cylindrical bore and an adjacent upstream inclined seat 56 that tapers downwardly and inwardly.

A shape-retaining washer 58, molded of plastic, preferably polyethylene, is positioned above coplanar surfaces 38 and 46 respectively of guide ring 34 and plug member 40. The shape-retaining washer 58 is supported at least upon the annular support edge 38 of guide ring 34, but as shown, the outer annulus 60 of washer 38 also overlies and engages a portion of surface 46 of plug member 40.

The washer 58 has radially spaced outer and inner concentric annular lands, respectively 60 and 62, joined together by four circumferentially spaced radial lands 64. The inner annular land 62 surrounds and defines a central flow passageway 66. The annulus between the outer and inner lands 60 and 62 has provided therein a plurality of circumferentially spaced primary flow passageways 68 that are shown to be of arcuate, generally oval, shape and through which initial flow of liquid is directed downstream, in a manner to flush against, scrub, and dislodge from the slots 48 any debris that may have become lodged therein. The debris that is flushed from slots 48 will then pass downstream through the central flow opening 52 of said plug member 40, and will easily pass through coarse mesh screens 22 and 24 out of the aerator.

There is also provided, downstream of the shape-retaining washer 58, a flow-blocking valve member 70 molded of plastic, preferably Delrin. The valve member 70 is a body of revolution providing an inverted cup shape with an upstream transverse wall 72 and an axially-extending cylindrical side wall 74 that surrounds a recess 75. The valve member 70 is adapted to engage the downstream side of washer 58, prior to start of flow through aerator 10, to block flow of liquid through the central flow passageway 66.

Provided concentrically on valve member 70, and as part thereof, is an annular flange 76 that is cantilevered from side wall 74 through a frusto conical connecting flange 78. At least an annular portion of the upstream edge of flange 76 engages land 62 simultaneously with wall 72. An annular recess 80 is defined between concentric sidewall 74 and flange 76. The diameter of central flow passageway 66 in washer 58 is less than the diameter of transverse wall 72. The diameter of opening 52 in plug member 40 is greater than the diameter of transverse wall 72 and the diameter of side wall 74, but is less than the maximum diameter of frusto conical wall flange 78. When the valve member 70 is moved by flow of liquid, downstream to its position shown in phantom by broken lines in FIG. 1, the downstream surface of frusto conical flange wall 78 engages and seats against the inclined wall 56 on plug member 40.

The thickness of the flange walls 76 and 78 and the nature of the plastic material, Delrin, of which part 70 is formed, are such that flange wall 78 will, under pressure of flowing liquid entering recess 80 during steady state flow conditions in the aerator, flex and deflect as needed to cause frusto conical flange wall 78 to conform to the shape of the seat 56 defined on the plug member 40, to the end that a seal is formed between members 70 and 40 to prevent flow of liquid through the central aperture 52 of the plug member.

The means for maintaining the valve member 70 in its upstream position, as shown in full lines in FIG. 1, includes a helical spring 82 having an upstream end **82*a*, that is press fit into the recess 75 of valve member 70, and a downstream end 82*b* that is flared outwardly in a generally conical shape, as shown. The lowermost portion of spring end 82*b* engages and is supported by the screen 22. To prevent lateral movement of the spring end 82*b*, the central portion of screen 22 is deformed to provide an upstream bulge 23, generally of rounded pyramidal shape, that serves as a stud over which the spring end 82*b* fits. In an alternate form of construction, shown in FIG. 3, the aerator uses a flat screen 22', and the spring end 82*b* merely engages screen 22'**.

The outer annular land 60 of the washer 58 is of such radial width that a radial inner portion thereof overlies a portion of upper annular support flange 42 of the plug member, and this arrangement serves to substantially block flow of liquid through the joint defined between the annular guide ring 34 and the plug member 42.

The shape-sustaining washer 58, when made of polyethylene, has sufficient resiliency for use as a deformable washer to effect sealing during connection of the aerator 10 with the discharge end of a spout to which the aerator is to connect. If greater sealing resiliency is required because of the nature of material, such as Delrin, used to form washer 58, then a resilient rubber washer 84 should be used to effect a sealing relationship of the aerator 10 with a faucet spout. The resilient, deformable washer 84 would rest upon washer 58, as seen in FIG. 1, and has an inner diameter substantially as shown that is selected to avoid interfering with flow through primary flow apertures 68 in washer 58.

Reference is made to FIG. 2 which illustrates many of the slots 48 of the plug member 42 being exposed through primary flow apertures 46, so that water passing through apertures 46 will flush from the exposed fine slots 48 any debris that may have been captured in those slots. The total washer aperture area, of all the primary flow apertures 68 and central flow aperture 66, and shape and location of apertures 68 are selected relative to the position and discharge capacity of slots 48 so that when central aperture 66 is blocked, when flow is first initiated, there is provided a directed liquid flow through apertures 68 at increased velocity to effect a scrubbing action of the jet-defining slots 48 to dislodge debris therefrom. It will be appreciated that until the valve member 70 has been fully depressed to the broken line position in FIG. 1, there can be higher liquid velocity and pressure developed by the fluid passing through flow passageways 68. The liquid pressure drops and surges in the region adjacent the slots 48, during the brief time period before valve member 70 seats against plug member 40 and establishes a steady flow-condition, aids and contributes to the scrubbing and flushing action of the liquid in effecting cleaning of debris that may be temporarily lodged in slots 48.

Figure 5:
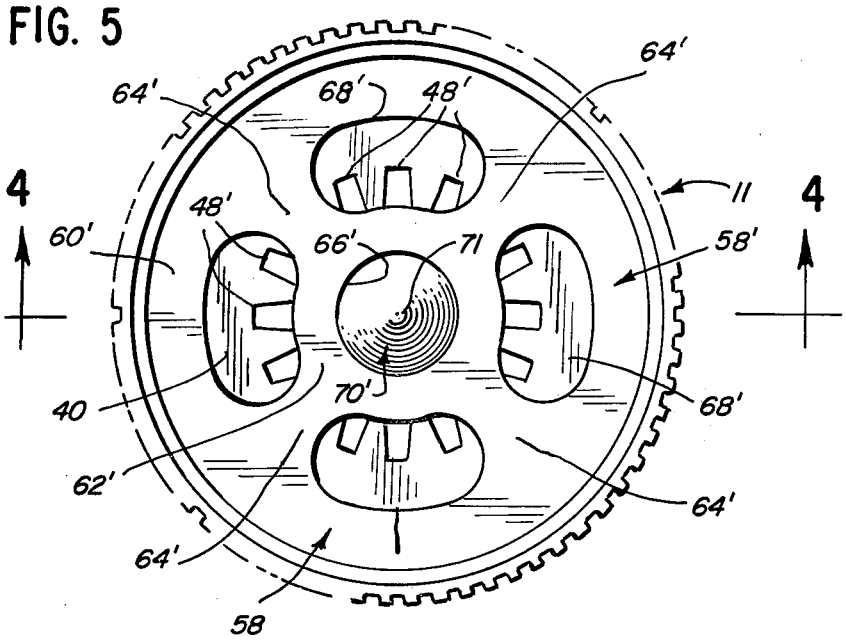
Figure 4:
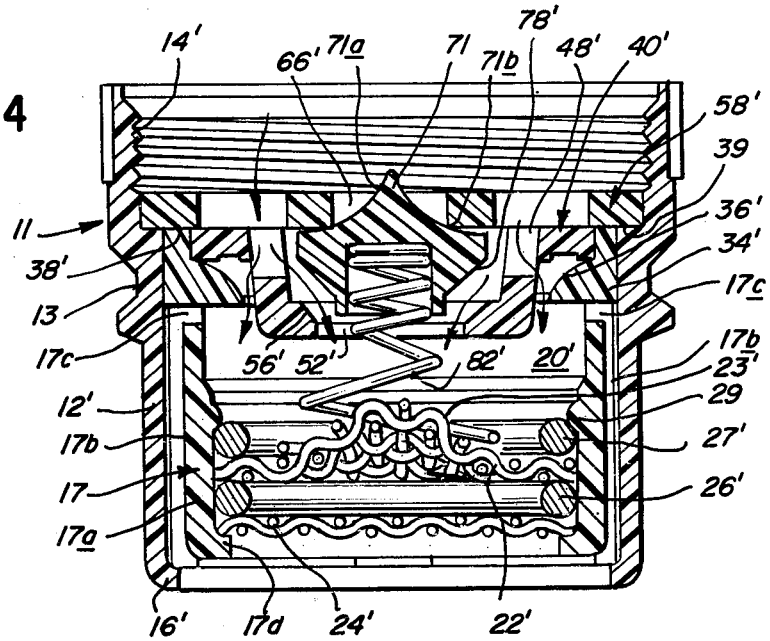
FIG. 4 is a vertical axially cross-sectional view, similar to the one in FIG. 1, through another form of aerator constructed in accord with the features and principles of the invention disclosed in FIGS. 1–3 and further showing the inclusion of a noise reduction feature.
Figure 6:
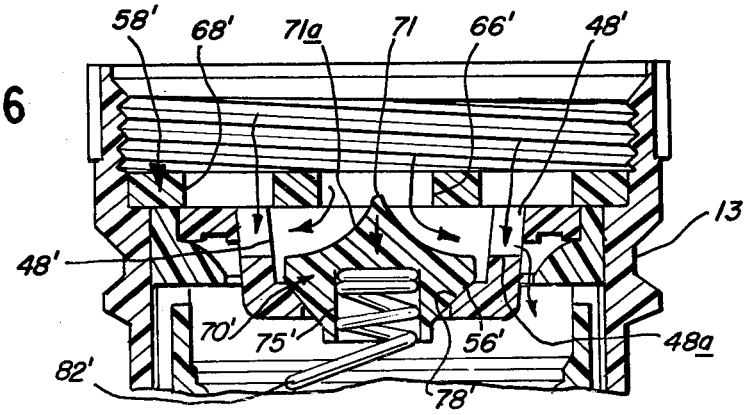
FIG. 6 is a fragmentary view of the upper portion of FIG. 4 showing the valve member in the aerator fully depressed during liquid flow through the aerator.

In the form of aerator shown in FIGS. 4–6, the aerator, generally 11, is of the slotless type with a generally tubular casing 12' and with air being ingested upwardly into the aerator through the open downstream end of the casing 12'. The casing 12' is shown formed with an exterior peripheral groove 13 adapted to receive therein ball-like elements of a snap connector, as is well known in the art.

The casing 12' is female threaded at 14' at its upstream end. The downstream end of casing 12' provides an inturned flange 16' which supports therein a molded part, generally 17, that is shaped to include a continuous annular inner sleeve **17*a* formed on its exterior with a plurality of axially extending, and circumferentially spaced ribs 17*b* thereon through which molded part 17 is supported on flange 16'. At the same time, spaced ribs 17*b* define therebetween air flow passageways for entry of air through lateral passageway portions 17*c* into the water-and-air mixing chamber 20'**.

The cylindrical portion **17*a* of part 17 is shaped to provide an inturned flange 17*d* that supports a lower screen 24' of coarse mesh with a formed upper screen 22' separated from screen 24' by a split spacer ring 26' that is pressfit into annular inner sleeve 17*a*, and with the upper screen 22' held in assembled position by a split snap ring 27' that is pressfit past a retention bulge 29 defined on the inner wall of annular inner sleeve 17*a***.

The upper screen 22′ may be shaped as shown to provide an upwardly projecting bulge 23′ that serves as a stud over which the lower portion of spring 82′ fits.

The ribs 17*b* terminate at their upper ends in a common plane to provide a support for guide ring 34′. The guide ring 34′ is shaped to provide thereon an annular convex impingement surface 36′ which extends radially inwardly and curves in a downstream direction. The guide ring 34′ also provides an upstream, annular, support edge surface 38′ that is located in the same plane with an annular shoulder 39 defined on casing 12′. Mounted on the guide ring 34′ and supported on the outermost annular portion of convex surface 36′ is a cup-shaped plug member 40′ that is of the same shape and construction as plug member 40 shown in FIGS. 1–3 and described above, with a series of circumferentially spaced, axially elongated, radial slots 48′ through which flowing water is directed against the impingement surface 36′ of the guide ring 34′. The lower end of plug member 40′ also provides an opening 52′ and upstream inclined seat 56′.

Seated on the surfaces 38′ and 39 and against portions of the upper surface of plug member 40′ is a shape-retaining washer 58′ molded of plastic, preferably polyethylene, and shaped to provide radially spaced outer and inner concentric annular lands, respectively 60′ and 62′, joined together by four circumferentially spaced radial lands 64′. The inner annular land 62′ surrounds and defines a central flow passageway 66′. The annulus between the outer and inner lands, 60′ and 62′, is provided with a plurality of circumferentially spaced primary flow passageways 68′ that are shown to be of arcuate, generally oval, shape. Water passing through the passageways 68′ flushes against, scrubs and dislodges from slots 48′ of plug member 40′ any debris that may have become lodged therein.

The aerator of FIGS. 4–6 also includes a valve member 70′ which is a body of revolution molded of plastic, preferably Delrin. The downstream portion of valve member 70′ corresponds with the downstream portion of valve member 70 of FIGS. 1–3 described above, as valve member 70′ includes an inverted cup-shaped recess 75′ for receiving thereinto the upper end of spring 82′, and the surface 78′ on valve member 70′ is of a shape to conform to and seat against seat 56′ when the valve member 70′ is moved downstream by force of flowing water as seen in FIG. 6.

What is different in valve member 70′ of FIGS. 4–6 from valve member 70 shown in FIGS. 1–3, is that the upstream facing surface of valve member 70′ is shaped to provide a central cusp having a greatest diameter that is larger than the diameter of the central flow opening 66′ of the washer 58′, and providing an axially elongated cone or cusp apex, 71 that is of a length to extend to a point spaced upstream of washer 58′ when valve member 70′ is in the position of FIG. 4, and with a concavely curved surface 71*a* extending downstream from the apex of cone 71 to provide a flared sidewall for gently turning axially flowing water, that has passed through the central flow passage 66′ to cause such liquid to flow in a radial direction toward slots 48′, and aiding in flushing debris from the slots 48′. As seen in FIG. 6, the dimensions of valve member 70′ are such that when valve member 70′ is seated against surface 56′ of plug member 40′ the radial outward terminus of concavely shaped sidewall 71*a* is substantially co-planar with the lower edges 48*a* of jet-forming slots 48′, thereby directing water flow through the entire axial length of slots 48′. The shape of the concavely curved sidewall 71*a* provides for engagement thereof along circular line 71*b* with the downstream edge of the aperture 66′ to effect a seal therebetween when valve member 70′ is in the position of FIG. 4.

The provision of the cusp, or cone, 71 on the upstream portion of valve member 70′ and the use of the smoothly flared sidewall 71*a* provides for both a sealing function between valve member 70′ and disc 58′ (FIG. 4) and also provides a noise reducing function.

While particular embodiments of this invention have been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. In an aerator that includes: an axially elongated tubular casing having means through which air is ingested to the interior of the casing to be mixed with fragmented liquid jets; screen means within and adjacent the downstream end of said casing through which aerated liquid is discharged; and plastic jet-defining and jet-fragmenting means, within the casing and upstream of said screen means, through which liquid to be aerated is forced under pressure consisting of: (1) an annular guide ring with a downstream annular impingement surface defined thereon and having an upstream, annular, support edge disposed in a plane; and (2) a cup-shaped plug member having an upper annular support flange slidingly telescoped into said guide ring and an upright side wall projecting downstream from the inner edge of said annular peripheral flange, the upstream side of said support flange lying in the same plane with the annular support edge of the guide ring, the upright side wall being provided therein with a series of axially elongated slots that extend downstream from the upstream side of said support flange and operates to provide the liquid required to effect aeration of the liquid;

the improvement of self-cleaning and noise reducing character for said aerator comprising, in combination:

(a) said plug member being formed as an annulus with a relatively large central flow opening through the downstream transverse wall of said cup-shaped member;

(b) a shape-retaining washer supported at least on the annular support edge of the guide ring; said washer having radially spaced outer and inner concentric annular lands interconnected by a plurality of radial lands, the inner annular land bounding and defining a central flow passageway, and the annulus between said outer and inner annular lands providing therethrough a plurality of circumferentially spaced primary flow passageways through which flow of liquid is initially directed downstream to scrub and dislodge, from the plug member's axially elongated slots, debris that may have lodged therein, and to flush same through the central flow opening of said plug member;

(c) a flow-blocking valve member located downstream of the washer and being resiliently biased upstream toward engagement with the washer, said valve member being movable downstream under force of flowing liquid to close the central flow opening of the plug member after dislodged debris has passed therethrough, and to restore normal aerating operation of the aerator; and (d) the upstream end of said valve member having a diameter greater than the diameter of the central flow opening of the washer and being shaped to provide thereon both a seal portion for engaging and sealing against the downstream periphery of the central flow passageway through the washer, and a cavitation noise reducing means.

2. A construction as in claim 1 wherein said seal portion for sealing the downstream periphery of the central flow passageway and the cavitation noise reducing means is in the form of an elongated cone that extends from the flow-blocking valve member upstream into said central flow passageway in the washer.

3. A construction as in claim 2 wherein the apex of the cone extends to a point spaced upstream of the washer.

4. A construction as in claim 3 wherein the cone has a smoothly flared side wall for gently turning the axial flow, that passes through the central flow passageway through the washer, into a flow in radial directions.

* * * * *